United States Patent [19]

Reuland

[11] 4,284,087

[45] Aug. 18, 1981

[54] METHOD AND APPARATUS FOR PRODUCING AN ELONGATED WRAPPED ROD FROM FIBERS, ESPECIALLY TOBACCO SHREDS

[75] Inventor: Joachim Reuland, Neu Börnsen, Fed. Rep. of Germany

[73] Assignee: Hauni-Werke Körber & Co. KG., Hamburg, Fed. Rep. of Germany

[21] Appl. No.: 61,351

[22] Filed: Jul. 27, 1979 (Under 37 CFR 1.47)

[30] Foreign Application Priority Data

Jul. 28, 1978 [DE] Fed. Rep. of Germany ..... 2833124

[51] Int. Cl.[3] ..... A24C 5/14; A24C 5/39

[52] U.S. Cl. ..... 131/84 C; 131/906

[58] Field of Search ..... 131/84 R, 84 C, 21 B, 131/21 C, 21 D, 21 R

[56] References Cited

U.S. PATENT DOCUMENTS

| | | | |
|---|---|---|---|
| 3,750,675 | 8/1973 | Klemme | 131/21 B |
| 4,036,238 | 7/1977 | Okumoto | 131/21 B |
| 4,037,608 | 7/1977 | Wahle | 131/21 B |
| 4,190,061 | 2/1980 | Heitmann et al. | 131/21 B |

*Primary Examiner*—Stephen C. Pellegrino

*Attorney, Agent, or Firm*—Peter K. Kontler

[57] ABSTRACT

The making of an elongated tobacco stream which is to be densified, wrapped and severed for conversion into discrete cigarettes is controlled in dependence on the resistance of the stream to the flow of a gaseous fluid thereacross prior to removal of the surplus of tobacco. The signal which is generated to effect the control may be influenced by a parameter, such as the height of the stream prior or subsequent to removal of the surplus, and such signal determines the distance between the plane in which the equalizer removes the surplus from the stream and a conveyor which advances the stream lengthwise. Such signal may be formed as a function of several parameters.

30 Claims, 11 Drawing Figures

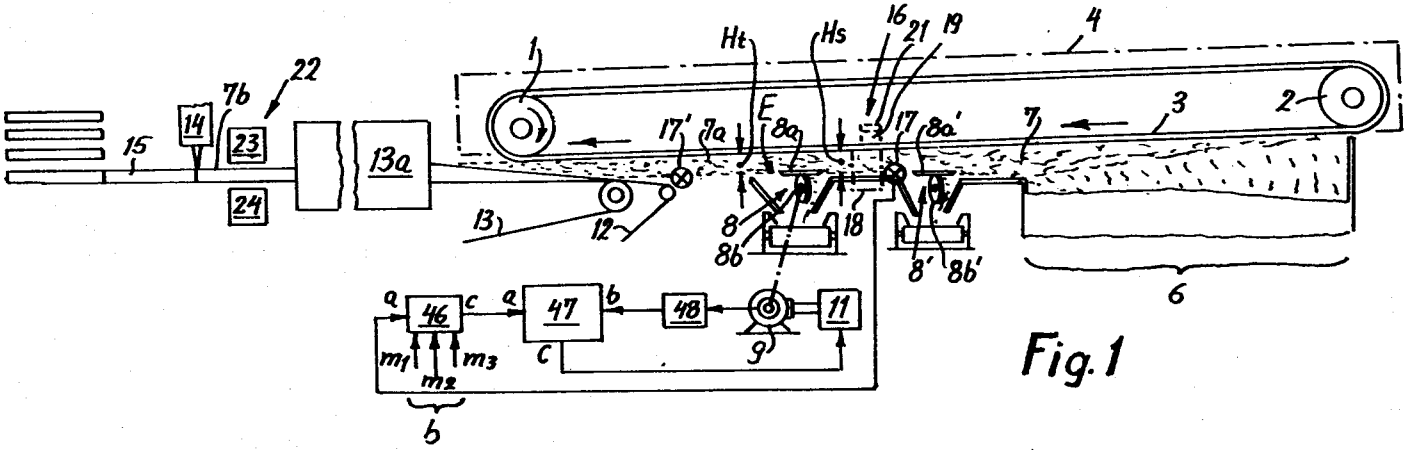
Fig. 1
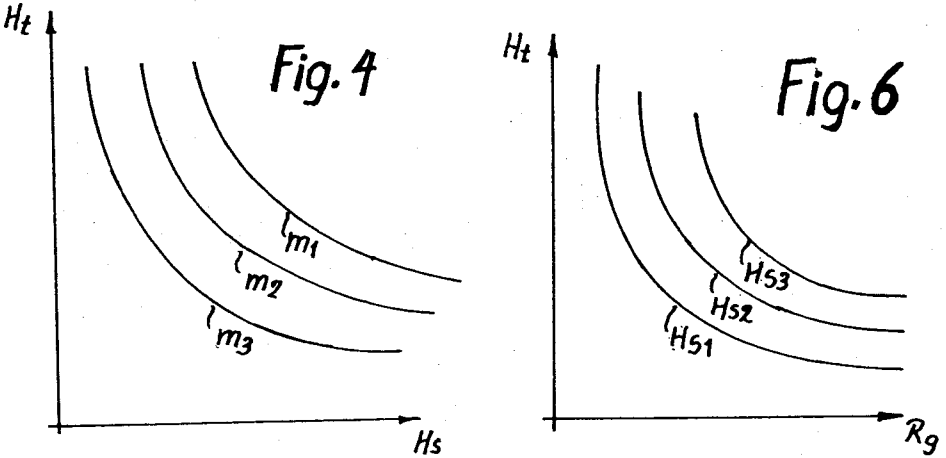
Fig. 4
Fig. 6
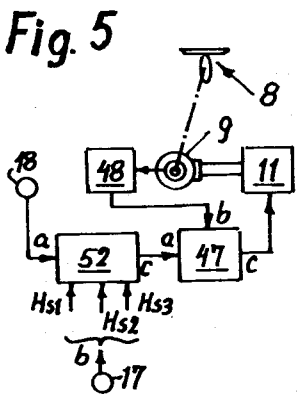
Fig. 5

Fig. 2
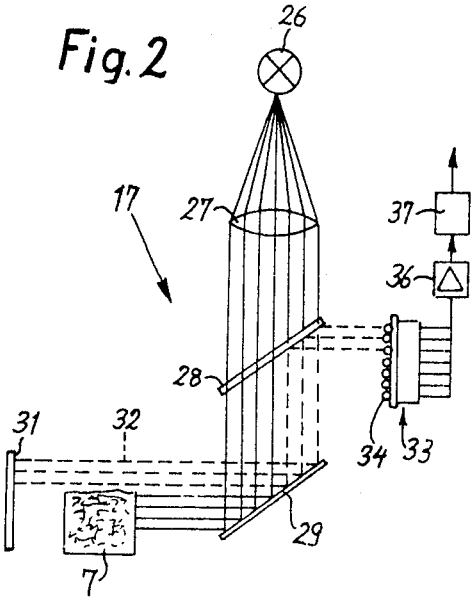
Fig. 3
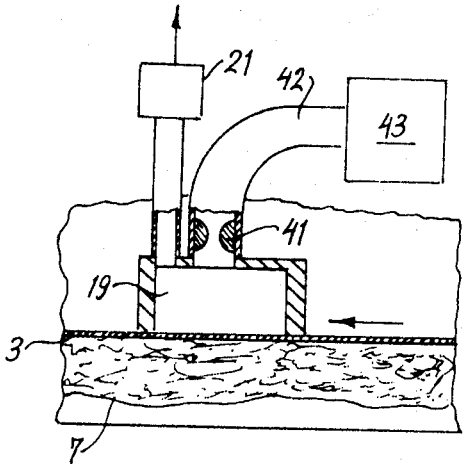
Fig. 7
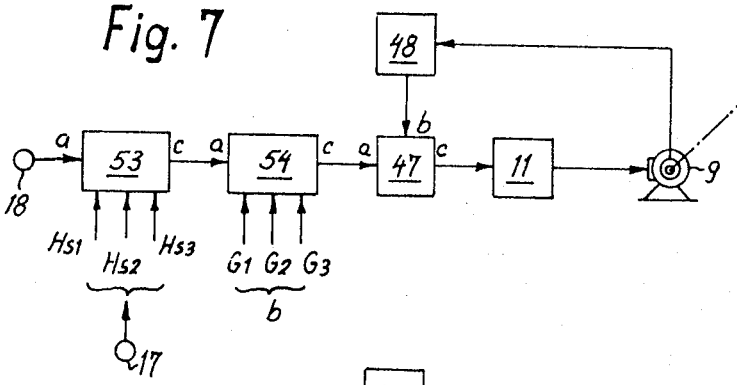
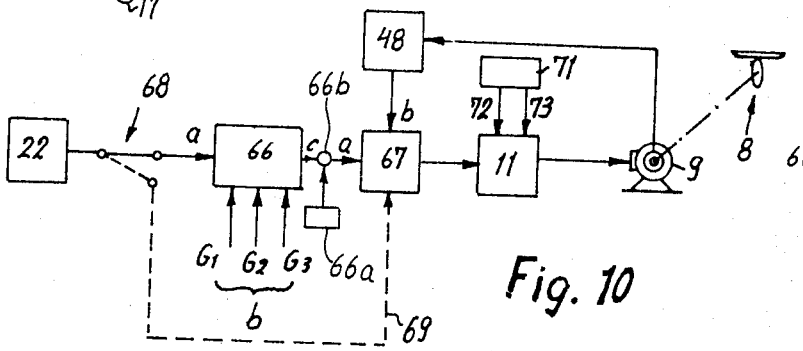
Fig. 10
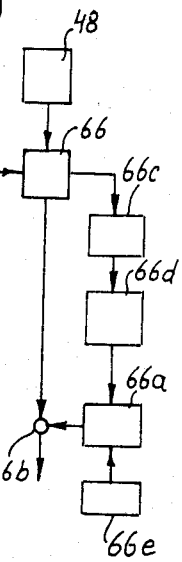
Fig. 10a 129
131
128
137
138
123
5a
125
7
3
120
124
5b
127
126
132
134
136
133
141
139
20
SM1
SM2
a1
a2
238
236
m1
m2
237a
237b
237c
237e
237f
237h
237i
237j
237l
237m
61
47
11
48
8
9
G1
G2
G3
b

METHOD AND APPARATUS FOR PRODUCING AN ELONGATED WRAPPED ROD FROM FIBERS, ESPECIALLY TOBACCO SHREDS

BACKGROUND OF THE INVENTION

The invention relates to a method and apparatus for producing an elongated wrapped rod from fibers, especially from tobacco shreds. More particularly, the present invention relates to cigarette making machines and a method of making cigarettes.

It is already known, particularly in the cigarette making industry, to form a stream from fibers, to advance the stream, to equalize the advancing stream by removing the surplus of fibers therefrom, and to densify and wrap the equalized stream so as to form a filler (such as a cigarette rod from which individual cigarettes are to be severed). It is further known to control the removal of the surplus of fibers in dependence on a signal which is indicative of the resistance of the stream to the flow of a gaseous fluid transversely of the direction of advancement of the stream.

The conventional apparatus capable of performing such method employ a conveyor on which the stream is formed and by means of which the stream is advanced, an equalizer which removes the surplus of fibers from the advancing stream at a removal location, a device for densifying the stream downstream of the equalizer and for wrapping the densified stream into a web of cigarette paper or the like, a monitoring device for monitoring the resistance of the stream to the flow of a gaseous fluid transversely of the direction of advancement of the stream, and a control arrangement which varies the distance between the equalizer and the conveyor in response to signals which are transmitted by the monitoring device.

The term "densification", is intended to denote the transformation of the equalized, but not yet wrapped, stream into a filler having the cross section of the wrapped tobacco rod (or cigarette rod), from which the individual cigarettes are severed on a continuing basis. Such transformation is carried out in a wrapping mechanism in which the tobacco is compressed during its passage therethrough and which, consequently, acts as a densifying arrangement. However, in the event that the tobacco in the tobacco filler is already considerably compressed during advancement to the equalizing location and/or the wrapping mechanism (for instance, by subjecting the tobacco stream, through the air-permeable conveyor which advances the same, to a pronounced subatmospheric pressure), it can happen that the cross section of the equalized tobacco stream is the same or even smaller than the cross section of the cigarette rod. In such case, the expression "densification" is intended to mean the transformation of the tobacco stream into a body having the cross section of the wrapped cigarette rod.

It is known to control the removal of tobacco fibers in dependence on a signal which is a function of the resistance offered by the stream to the flow of air therethrough transversely of the direction of advancement of the stream. For this purpose, it has been proposed to position laterally of the stream a nozzle which is connected with a suction generating device so that an air current flows transversely of and through the tobacco stream. A pneumatic value of such air current is sensed and serves as a control signal for an equalizer which removes the surplus of tobacco from the stream downstream of the monitoring or sensing location. The signal which is obtained in the above-described manner does not correspond to the density of tobacco in the stream, but only to the flow resistance. However, such signal is influenced by the density. Therefore, the removal of tobacco in dependence on such signal does not ensure constant density in the strand. Instead, the resistance of the stream to transverse flow of a gaseous fluid across the stream is kept at a constant value.

OBJECTS AND SUMMARY OF THE INVENTION

It is an object of the invention to provide a method of controlling the making of a cigarette rod or a similar elongated article which renders it possible to achieve constant rigidity hardness or mass flow of the finished product.

Another object of the present invention is to provide a method which renders it possible to take into account several variable parameters of the stream which is used for the manufacture of the ultimate product.

A concomitant object of the invention is to provide an apparatus for the practice of the above-mentioned method.

An additional object of the present invention is to construct the apparatus in such a way that it is relatively simple, inexpensive, easy to operate and reliable.

One feature of the present invention resides in the provision of a method of producing an elongated filler from fibers, especially tobacco shreds, which comprises the steps of continuously forming from the fibers an elongated stream which contains a surplus of fibers and advancing the stream lengthwise; equalizing the advancing stream by removing the surplus of fibers therefrom, densifying and wrapping the equalized stream to convert the stream into the filler, generating a signal in dependence on the resistance of the stream to the flow of a gaseous fluid prior to the equalizing step and transversely of the direction of advancement of the stream, correcting the signal in accordance with a function which is selected for a desired rigidity of the filler and represents a defined correlation between the height of the equalized stream prior to the densifying step and the signal, and controlling the equalizing step in dependence on the corrected signal that the rigidity of the filler remains constant.

It is within the purview of the invention to form the corrected signal which controls the removal of surplus fibers in dependence on the first mentioned signal by correcting the first mentioned signal in accordance with a function which is selected for a desired value of the density (mass flow) of the wrapped and densified stream (cigarette rod) and represents a predetermined relationship between the height of the equalized non-densified stream and the signal which depends on the resistance of the stream to the flow of a gaseous fluid; the corrected signal which is formed in this way can control the distance between the location of removal of the surplus and the conveyor in the sense of maintaining the density of the wrapped and densified stream at a constant value. This embodiment of the method cannot be practiced by resorting to conventional nozzles inasmuch as the nozzles can only ensure a control for the purpose of achieving a constant resistance to the flow of a gaseous fluid across the stream.

The signal which is dependent on the flow resistance can be formed by means of an air current which is drawn transversely of the direction of the unwrapped stream and through the stream prior to equalization.

In the event that the stream cannot, or cannot be readily formed in such a way that its height is at least approximately constant, such desirable condition can be achieved, in that the tobacco stream is brought to a constant height upstream of the monitoring location by the removal of surplus tobacco.

In the event that, for special reasons, it is impossible to supply to the monitoring location a tobacco stream of an at least approximately constant height the removal of surplus tobacco fibers for the purpose of forming a cigarette rod of constant rigidity (or density) can be anticipatorily influenced by a signal which is formed in dependence on the height of the non-equalized stream as measured at right angles to the direction of advancement of the stream. A method which is especially advantageous inasmuch as it does not affect the stream involves generation of the measuring signal in an optoelectronic manner.

The terms or anticipatory control or influencing are intended to denote that a variable parameter (the extent of removal of fibers) is controlled in dependence on a monitored parameter of a section of the stream upstream of the removal location so that the variable parameter is adjusted in the required manner in anticipation of the arrival of the above-mentioned section at the removal location.

A combination of the above-mentioned methods which is recommended for varying the mass flow (density) and for varying the height of the non-equalized stream can be achieved, by generating a signal corresponding to the height of the stream as well as to the flow resistance, and in that the signal for anticipatory control of the removal of surplus fibers is formed by the signal which denotes the density and is corrected in dependence on a function that is selected for a desired value of the rigidity (or of the mass flow) wrapped and densified stream (cigarette rod) and represents a predetermined relationship between the height of the equalized non-densified stream and the signal denoting the density.

A control signal which is generated by the above-mentioned monitoring devices which are situated upstream of the location of removal of surplus fibers and serves for advance control of the removal of surplus fibers can be transmitted as a desired value signal to a circuit which varies the position of the plane of removal of surplus tobacco. The actual value signal for such circuit is formed in dependence on the height of the equalized non-densified stream. When the two signals differ, the position of the location of removal of surplus tobacco relative to the conveyor is changed.

The so-called "advance control" of removal of tobacco for the formation of a cigarette rod of constant rigidity (or density) in dependence on signals which are furnished by signal generators (height and/or flow resistance of the stream) mounted upstream of the location, of removal of the surplus exhibits the advantage that the tobacco stream can still be influenced when it reaches the aforementioned location. A certain disadvantage of such advance controls (which are also referred to herein as anticipatory controls and operate very quickly is that the results of the control interventions can slowly drift away from the desired value inasmuch as no further supervision takes place after the intervention. According to an important further development of the invention, such situation is avoided in that the removal of the surplus of tobacco is additionally controlled by a control signal which is formed in dependence on a first signal denoting the mass flow (density) of the equalized stream, preferably after wrapping, wherein the first signal for the formation of the control signal is corrected in dependence on a function which is selected for a desired value of the rigidity (or mass flow) of the wrapped stream and represents a predetermined relationship between the height of the equalized non-densified stream and the first signal. The control signal can constitute the desired value signal for a circuit for regulation of the position of the plane, of removal of surplus tobacco actual value signal for such circuit is formed in dependence on the height of the equalized non-densified stream, when the two signals differ, the position of the aforementioned location relative to the conveyor is changed.

The sensing of the actual height of the stream can take place, in a contactless manner, for instance, optoelectronically. A particularly advantageous sensing of the height of the stream involves monitoring the distance between the location of removal of surplus and the conveyor, inasmuch as the position of such location determines the height of the equalized non-densified stream.

The apparatus which can be used for the practice of the above outlined method is characterized in that a function generator is connected to the monitoring device which is mounted upstream of the location, of removal of the surplus of fibers. The signal which appears at the output of the function generator is formed in dependence on a function which represents, for the desired rigidity of the densified and wrapped stream, a predetermined relationship between the height of the equalized non-densified stream and the signal denoting the resistance of the non-equalized stream to the flow of a gaseous fluid therethrough. The output signal is transmitted as a control signal to an arrangement for controlling the height of the equalized non-densified stream.

A preferred monitoring device comprises a suction chamber which is placed next to the conveyor to draw air through the tobacco stream and the conveyor; the signal itself is transmitted by a transducer and denotes a pneumatic value of the air current which is drawn transversely through the stream. Such pneumatic value is influenced by the resistance of the fibers in the stream to the flow of air across the stream.

When it is required to control the removal of surplus tobacco in the sense of maintaining the density of the equalized tobacco stream at a constant value, it is desirable to provide a function generator the output signal of which is formed in correspondence with a function which, for the desired density (mass flow) of the densified and wrapped stream, represents a predetermined relationship between the height of the equalized non-densified stream and the signal denoting the resistance of the non-equalized stream to the flow of a gaseous fluid. Such signal is transmitted to the control arrangement as a control signal for varying the height of the equalized non-densified stream.

The improved apparatus operates especially accurately when the height of the non-equalized stream which is supplied to the equalizer is at least approximately constant. In the event that this cannot be assured during the formation of the stream an auxiliary equalizer for smoothing the surface of the stream whichis supplied to the height monitoring device can be provided upstream of the monitoring location.

For further influencing the removal of the surplus of tobacco fibers for the purpose of forming a cigarette rod of constant rigidity (or density) there can be provided a monitoring device which is situated upstream of the location of removal of the surplus and senses the height of the non-equalized stream. The output signal of such device can be transmitted to the control arrangement. An optoelectronic monitoring device is especially suited inasmuch as it does not disturb the stream. According to the invention, a function generator is connected to such monitoring device and transmits an output signal which is formed in correspondence with a function that, for the desired rigidity (or density) of the densified and wrapped stream, represents a predetermined relationship between the height of the equalized non-densified stream and the signal which corresponds to the height of the non-equalized stream. Such output signal is transmitted to the control arrangement as a control signal for varying the height of the equalized non-densified strand.

A combination of the just discussed control possibilities which is recommended for varying the mass flow (density) and for varying the height of the non-equalized stream. Such combination can be achieved, by connecting a function generator to the devices which monitor the height of the stream and the flow resistance of the stream and are installed upstream of the location, removal of the surplus. The output signal of the function generator is formed in accordance with a function which, for the desired rigidity (or density) of the densified and wrapped stream, represents a predetermined relationship between the density of the equalized non-densified stream and the signals which denote the height of the stream as well as the resistance of the non-equalized stream to the flow of a gaseous fluid. The output signal is transmitted to a further function generator whose output signal is formed in correspondence with a function which, for the desired rigidity (or density) of the densified and wrapped stream, represents a predetermined relationship between the height of the equalized non-densified stream and the signals denoting the density of the non-equalized stream. The output signal of the further function generator is transmitted to the control arrangement as a control signal for varying the height of the equalized non-densified stream.

A signal which is furnished by the above-mentioned function generators can be transmitted as a desired value signal to a circuit for regulating the position of the equalizer. Then, a monitoring device which senses the height of the equalized non-densified stream and can constitute a contactless monitoring device (preferably an optoelectronic monitoring device) or a monitoring device which senses the position of the equalizer relative to the conveyor, serves as an actual value signal generator.

The drawbacks of the above-mentioned so-called advance controls, particularly that the rigidity or density of the stream may slowly drift away from the respective desired value, can be avoided by the provision an additional device which monitors the mass flow (density) of the equalized and preferably. A function generator is connected to this monitoring device and its output signal is formed in accordance with a function which represents, for a desired rigidity (or density) of the densified and wrapped stream, a predetermined relationship between the height of the equalized non-densified stream and the first mentioned signal. Such output signal is transmitted to the control arrangement as a control signal for varying the height of the equalized non-densified stream. This intervention into the control means constitutes a true regulation, inasmuch as the output signals are formed after the signals generated by the advance controls have already become effective. Therefore, any deviations which, constitute long-term variations, are sensed and compensated for by the regulation which is somewhat slower than the advance controls.

Accordingly, the function generator of the above-mentioned device for monitoring the density of the wrapped stream is a desired value signal generator of a position-regulating circuit. A device which senses or monitors the height of the equalized stream and can constitute a contactless monitoring device (preferably an optoelectronic monitoring device) or a device which senses or monitors the position of the equalizer relative to the conveyor, is suited as an actual value signal generator of such position-regulating circuit. This position-regulating circuit can be the same position-regulating circuit which obtains desired value signals from the device for monitoring the height and/or the flow resistance of the non-equalized stream. Then, the position-regulating circuit is also supplied with an additional desired value signal from the device for monitoring the density of the wrapped cigarette rod.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a somewhat diagrammatic view of the building zone for a tobacco stream in a cigarette making machine which is equipped with a control arrangement for influencing the formation of the stream for the purpose of achieving a constant rigidity (or constant quantity of tobacco) in the cigarettes in dependence on measurement of the height of the stream;

FIG. 2 is a detail view of an optoelectronic device for monitoring the height of the non-equalized stream;

FIG. 3 is a detail view of a pneumatic device for monitoring the resistance of the non-equalized stream to the flow of a gaseous fluid transversely of the direction of advancement of the stream;

FIG. 4 is a diagram showing the functional relationship between the height of the non-equalized stream and the height of the equalized non-densified stream;

FIG. 5 shows a control arrangement for influencing the formation of the stream for the purpose of achieving a constant rigidity (or constant quantity of tobacco) in the cigarettes in dependence on the resistance of the tobacco stream to the flow of a gaseous fluid transversely of the direction of advancement of the stream;

FIG. 6 is a diagram showing the functional relationship between the resistance of the non-equalized stream to the flow of a gaseous fluid and the height of the equalized non-densified stream;

FIG. 7 shows a control arrangement for influencing the formation of the stream for the purpose of achieving constant rigidity (or constant quantity of tobacco) in the cigarettes in dependence on the height and the flow resistance of the non-equalized stream;

FIG. 10 shows an arrangement for influencing the formation of the stream for the purpose of achieving constant rigidity (or constant quantity of tobacco) in the cigarettes in dependence on the density of the equalized, densified and wrapped cigarette rod; and FIG. 10*a* shows a modification of the arrangement of FIG. 10.

DESCRIPTION OF THE PREFERRED EMBODIMENTS

Figure 8:
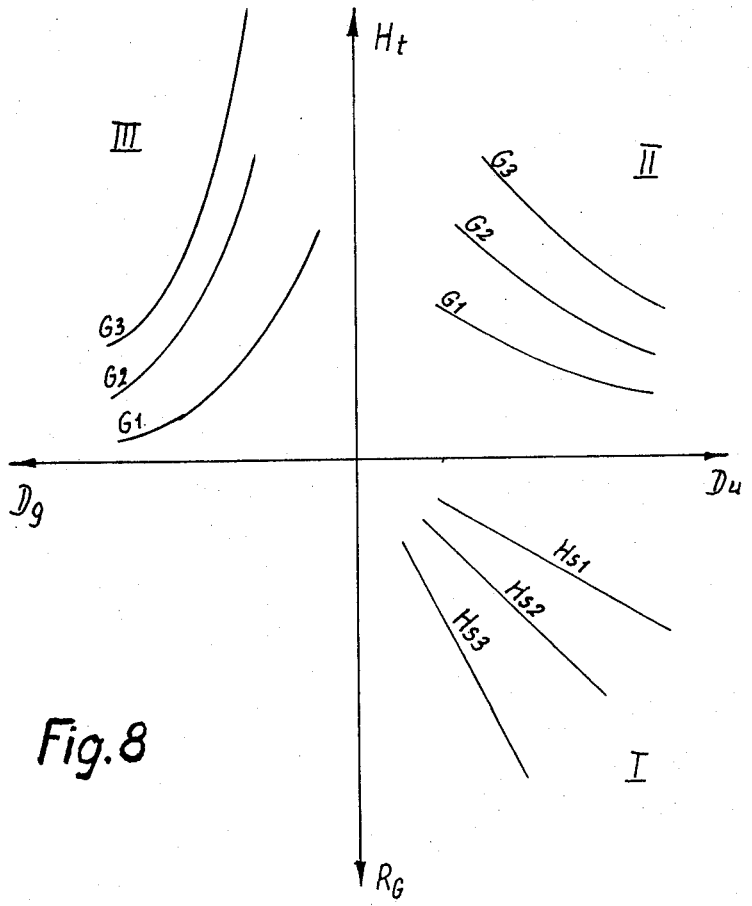
FIG. 8 is a diagram showing the functional relationship between the density of the stream as established from signals denoting the height of and the flow resistance of the stream, and the functional relationship between the density and the height of the equalized non-densified stream in dependence on different cigarette rigidities.

Referring first to FIG. 1, the reference numeral 3 denotes an air-permeable conveyor belt having a lower reach which is adjacent to the underside of a suction chamber 4. The conveyor belt 3 is trained about rollers 1 and 2, and travels above a stream building zone 6 in which fibers (e.g., shreds of tobacco) ascend (in that they are either mechanically flung up, e.g., by means of a brush, or transported by means of an air stream), and become and remain suspended, due to the subatmospheric pressure in the chamber 4, at the underside of the lower reach of the conveyor belt 3 in the form of a non-equalized stream 7. The conveyor belt 3 then advances the tobacco stream past a known equalizer 8 which removes the surplus of tobacco from the downwardly facing exposed surface of the tobacco stream 7. The equalizer 8 can comprise a rotating circular knife which cooperates with a serrated wheel. However, the equalizer can also be a device which is provided with clamping discs 8*a*, and wherein the surplus of tobacco is removed by means of a brush 8*b* (or a paddle wheel). Details of an equalizer of the last-mentioned type are disclosed, for instance, in U.S. Pat. No. 3,030,966.

The distance between a location (cutting plane) E of removal of surplus tobacco by the equalizer 8 from the conveyor belt 3 is adjustable by means of a drive 9 (positioning motor) which is controlled by a control arrangement 11.

An equalized non-densified tobacco filler or stream 7*a* is transferred onto a web 12 of wrapping material (in general, a paper strip), and is advanced by a garniture 13 through a wrapping mechanism 13*a* in which the tobacco filler 7*a* is densified and the web 12 is draped around the tobacco filler and glued to form a cigarette rod 7*b*.

In the event that the tobacco filler 7*a* is densified to, or even below, the cross section of the cigarette rod 7*b*, which can happen, for instance, as a result of compression due to a very low pressure in the suction chamber 4, the wrapping mechanism 13*a* merely imparts to the tobacco filler 7*a* the generally round cross section of the cigarette rod 7*b*. Even this possibility is to be embraced by the expression "densification" which has been used for the sake of simplicity.

Downstream of the wrapping mechanism 13*a*, cigarettes 15 are severed, from the cigarette rod 7*b* by a cutoff 14 and are conveyed away for further processing. A monitoring device 16 is arranged upstream of the equalizer 8. It can constitute or comprise an optoelectronic monitoring device 17 which scans the height of the non-equalized tobacco stream 17 (and thus the distance between the exposed surface of the stream and the conveyor belt 3). Details of this optoelectronic monitoring device are shown in FIG. 2. However, the monitoring device 16, can also comprise or constitute a pneumatic device 18 for monitoring the resistance of the tobacco fibers to the flow of a gaseous fluid transversely of the direction of advancement of the tobacco stream, that is, in a direction toward the conveyor belt 3. FIG. 3 shows details of the monitoring device 17. However, the monitoring device 16 can also include the monitoring devices 17 and 18.

The monitoring device 18, of which details are shown in FIG. 3, preferably includes a suction chamber 19 at that side of the conveyor belt 3 which faces away from the tobacco stream 7. The air current which flows through the tobacco stream 7 and the conveyor belt 3, and thus the pressure in the suction chamber 19, is dependent on the resistance of the tobacco fibers of the non-equalized tobacco stream to the flow of air thereacross 7. An electric signal corresponding to the pressure in the chamber 19 can be formed by means of a pressure sensitive semiconductor or a diaphragm transducer 21 which is known from the field of measuring pneumatic values.

A monitoring device 22 is mounted downstream of the equalizer 8 and transmits a signal which denotes the density of tobacco in the tobacco filler 7*a* which has been densified to a constant cross section, namely in the wrapped cigarette rod 7*b*. Advantageously, the monitoring device 22 is a beta-ray detector with an emitter 23 having a radioactive preparation capable of emitting beta-rays, and with a receiver 26 which may constitute for an ionization chamber.

FIG. 2 shows details of the optoelectronic device 18 for monitoring the height of the non-equalized tobacco stream 7. A light source 26 transmits, via lens 27, parallel light rays through a partially light transmitting mirror 28 and, via reflecting mirror 29, onto a second reflecting mirror 31. The tobacco stream 7 is advanced at right angles to the plane of the drawing across the path of light between the mirrors 31 and 29. In the illustrated, the tobacco stream 7 covers the light only in part so that some of the light rays, namely, the rays 32 which are indicated by broken lines, bypass the tobacco stream 7 and reach the mirror 31 while the remaining rays which are illustrated by solid lines are intercepted by the tobacco stream 7. The reflected light rays 32 return to the partially light transmitting mirror 28, which directs them to a photoelectric receiver 33. The latter includes a plurality of transducers (e.g., phototransistors) 34 which are stacked one above the other; in the illustrated embodiment, there are provided seven phototransistors. The non-existent upper part of the tobacco stream 7 is indicated by three phototransistors 34 which receive the reflected light rays 32. The three signals for the height of the tobacco stream 7 upstream of the equalizer 8, which are transmitted to the receiver 33 are amplified by an amplifier 36 and summed by a totalizing circuit 37. The signal at the output circuit 37 thus denotes the height of the tobacco stream 7.

Instead of an analog output signal, the optoelectronic monitoring device 17 can also transmit a digital output signal in that the individual transducers 34 correspond to certain digits of a number which is arrives for instance, in a binary manner.

FIG. 3 shows detail of the monitoring device 18 which generates and transmits a signal denoting the resistance of the non-equalized tobacco stream 7 to the flow of a gaseous fluid transversely of the direction of advancement of the stream. The suction chamber 19 is located at that side of the air-permeable conveyor belt 3 which faces away from the tobacco stream 7 and is connected with a suction generating device 43 by a flow restrictor 41 and a conduit 42. Further connected to the suction chamber 19 is a diaphragm transducer 21 which converts the value of pressure in the suction chamber 19 into an electrical signal. The pressure, on its part, is dependent on the resistance which the tobacco stream offers to the flow of a current of air from the exposed surface of the tobacco stream 7 through the latter and through the air-permeable conveyor belt 3 into the suction chamber 19.

The signal which is transmitted by the monitoring device 17 and denotes the height of the non-equalized tobacco stream 7 is applied, as indicated in FIG. 1, to the input a of a function generator 46 in which the value pairs for different distances between the location of the cutting plane E of the equalizer 8 and the conveyor belt 3 and thus for the height Ht of the equalized non-densified tobacco filler *7a* in dependence on the height Hs of the non-equalized tobacco stream 7 are stored. It is assumed that the stream building zone 6 receives tobacco at least substantially at a constant rate so that the quantity tobacco per unit of length of the non-equalized tobacco stream 7 is at least approximately constant.

In this case, the monitoring device 18 is not necessary. To the function generator 46, there can be supplied, for further influencing, besides the signals denoting the height Hs, signals which are applied to the corresponding inputs b, and denote different, but always constant, quantities of tobacco m1, m2, m3 per unit length of the stream wherein m1 corresponds to large m3 to small amounts. The relationship which is established by the function generator 46 between input signals Hs, quantity dependent signals m1, m2, m3 and the height Ht of the equalized non-densified tobacco stream *7a* for the formation of the cigarette rod *7b* and thus for the manufacture of cigarettes of constant rigidity is presented in the diagram of the FIG. 4.

The signal Ht, which is formed by the function generator 64 in an analog manner or calculated in accordance with a program corresponding to the predetermined function in a digital manner and appears at its output c, serves to control the removal of tobacco fibers in the sense of maintaining the "filling force" or "rigidity" of the equalized wrapped and densified tobacco stream (cigarette rod *7b*) and of the cigarettes 15 at a certain value. By the above-mentioned expressions, one active in the field of cigarette making understands the resistance which the cigarette offers to deformation in the elastic region, for instance, to a force applied by a constant weight or by the examining fingers of the smoker. This resistance is dependent on various influencing values such as the elasticity of the fibers, the quantity and/or the type of tobacco, etc. The smoker judges the quality of the cigarette predominantly in accordance with this "rigidity" inasmuch as he or she cannot examine the constancy of the quantity of tobacco for which the cigarettes have heretofore been controlled. Nevertheless, the function generator 46 can also be constructed in such a way that the signal at its output serves to control the removal of tobacco fibers so as to ensure a constant quantity of tobacco in the finished cigarettes. Then, the functional relationship between Hs and Ht conforms to this changed control value, namely, the quantity of tobacco (instead of "rigidity").

The signal at the output of the function generator 46 is transmitted as a desired value signal to a regulating circuit for the height Ht of the equalized non-densified filler *7a*. A position-regulating circuit for the cutting plane E of the equalizer 8 is suited for this purpose, inasmuch as it simultaneously determines the height of the equalized non-densified tobacco filler *7a*. To this end, the signal at the output of the function generator 46 is transmitted as a desired value signal to the input a of a signal comparing member or stage 47 of the position-regulating circuit. The input b of the signal comparing member 47 receives a signal which denotes to the height Ht of the equalized non-densified filler *7a*. This signal can be transmitted by an optoelectronic monitoring device 17' which has been illustrated only in a diagrammatic manner and can be constructed in the same way as that shown in FIG. 2. However, it is more advantageous to form the signal in dependence on the position of the cutting plane E of the equalizer 8, inasmuch as the such position is simultaneously a measure for the height of the equalized non-densified tobacco filler *7a*. To this end, there is provided a height-measuring or monitoring device 48 which is mounted on the equalizer 8 and the output signal of which is applied to the input b of the signal comparing member 47. The monitoring device 48 can be a well known, e.g., inductively operating, displacement measuring generator in which a piece of iron influences the inductance of a coil in accordance with the position of the iron.

A signal denoting a possible difference between the two signals which are applied to the signal comparing member 47 is transmitted as a regulating deviation to the control arrangement 11 which controls the drive (positioning motor) 9 of the equalizer 8 in such a manner that the location (cutting plane) E of removal of the surplus of tobacco reflects the intensity of the control signal Ht (desired value of the position-regulating circuit) which is transmitted by the function generator 46.

The just described control thus operates as a so-called "advance control" (also referred to herein as "anticipatory control") for maintaining the rigidity of the finished cigarettes at a constant value.

A further possibility of achieving advance or anticipatory control of the cutting plane E of the equalizer 8 in order to ensure constant rigidity (or constant weight) of the finished cigarettes is in dependence on the signals transmitted by the monitoring device 18 (FIG. 3). Herein, however, it is necessary to satisfy the requirement that the height Hs of the supplied non-equalized tobacco stream 7 be at least approximately constant. Then, the monitoring device 17 for the height of the non-equalized tobacco stream 7 can be omitted.

As illustrated in FIG. 5, the signal which is transmitted by the monitoring device 18 and denotes to the resistance Rg of the tobacco stream 7 to the flow of a gaseous fluid 7 between its exposed surface and the suction chamber 19 is applied to the input a of a function generator 52 in which there are stored value pairs for different distances between the cutting plane E of the equalizer 8 and the conveyor belt 3, and thus for the height Ht of the equalized non-densified tobacco filler *7a*, in dependence on the resistance Rg of the non-equalized tobacco stream 7 to the flow of a gaseous fluid. To the function generator 52, there can be supplied for further influencing, besides the signals corresponding to the flow resistance Rg, signals via corresponding inlets b which denote to different, but always constant, heights Hs1, Hs2, Hs3 of the tobacco stream 7. Hs3 corresponds to small and Hs1 to great heights.

The relationship which is established by the function generator 52 between the input signals Rg, the height-dependent signals Hs1, Hs2, Hs3, and the height Ht of the equalized non-densified tobacco filler *7a* for the formation of a cigarette rod *7b* and thus for the manufacture of cigarettes of constant rigidity, is illustrated in the diagram of FIG. 6.

The signal Ht which is transmitted by the output c of the function generator 52 in an analog manner or which is digitally calculated in accordance with a program corresponding to a predetermined function serves to control the removal of tobacco fibers to achieve constant rigidity of the cigarette rod *7b* and of the cigarettes 15. To this end, the output signal is again applied as a desired value signal to the input a of the signal comparing member 47 of a position-regulating circuit for the distance between the removal location E and the conveyor belt 3. An actual value signal is applied as a measure for the height Ht of the tobacco stream 7 subsequent to trimming by the equalizer 8, to the input b of the signal comparing member 47. This actual value signal is again advantageously generated in dependence on the position of the cutting plane E as determined by a height monitoring device 48. A signal denoting a possible difference between the two signals which are transmitted to the signal comparing member 47 controls, via control arrangement 11 and the positioning motor 9, the cutting plane E to maintain that value of Ht which is selected by the desired value signal.

Even in this kind of advance control (anticipatory control), the functional relationship between Rg and Ht can be selected that the amount of tobacco in the cigarette rope *7b* (per unit length) and thus in the cigarettes 15 is maintained at a constant value.

If the height of the supplied tobacco, stream 7 is not constant, a further equalizer 8' with clamping discs *8a'* and a brush *8b'* (FIG. 1) can be provided, for preliminary equalization upstream of the monitoring device 18 so that the tobacco stream 7 which reaches the monitoring device 18 has a constant height Hs.

When the conditions of the constant height Hs and constant quantity of tobacco, which are needed for the various controls of the equilizer 8 to ensure constant rigidity of the cigarettes (or constant quantities of tobacco in the cigarettes) are not satisfied, and, instead, pronounced inconsistencies are encountered, the position of the equalizer 8 can be regulated in accordance with the signal which is transmitted by the monitoring device 17 as well as in dependence on the signal which is transmitted by the monitoring device 18 in a manner as shown in FIG. 7.

The signal which is transmitted by the monitoring device 18 and depends on the resistance of the stream to the flow of a gaseous fluid is used to first establish the density Du of the non-equalized tobacco stream 7. To this end, the electrical signal corresponding to the flow resistance Rg and transmitted by the monitoring device 18, and the electrical signals Hs1, Hs2, Hs3 denoting the height of the stream and transmitted by the monitoring device 17, are applied to the inputs a and b of a function generator 53 whose output, in correspondence with part II of the diagram of FIG. 8, transmits a signal which denotes to the density Du of the non-equalized stream 7.

In part I of the FIG. 8, there are illustrated curves for the functional relationship between the flow resistance Rg and the density Du for different heights Hs1 (small), Hs2 (intermediate), Hs3 (great) of the non-equalized stream 7.

The signal at the output c of the function generator 53 denotes the density Du and is transmitted to the input a of a further function generator 54 to the input b of which there can be applied signals denoting certain values of the desired rigidity of or quantity of tobacco in the cigarette rod.

Part II of the diagram of FIG. 8 shows the functional relationship between the density Du of the non-equalized tobacco stream 7 and the position Ht of the cutting plane E of the equalizer 8 in order to obtain a certain rigidity values G1 (soft), G2 (intermediate), G3 (rigid) and so on, which are to be held constant, in the cigarettes (instead of the rigidity values, curves denoting desired different quantities of tobacco which are to be held constant can be selected for the control of quantities of tobacco).

The operation of the function generators 53, 54 is similar to that of the function generator of FIG. 1. Thus, the outputs c of these function generators transmit analog but preferably digital signals for each signal at their inputs a and in additional dependence on additional parameters represented by signals which are supplied to their inputs b in dependence on their respective predetermined functional relationships. The output signals then serve to control the removal of tobacco fibers for the formation of a cigarette rod *7b* and thus for the production of cigarettes of constant rigidity (or containing constant quantities of tobacco).

The signal at the output c of the function generator 54 is transmitted as a desired value signal to the input a of the signal comparing member 47 which is associated with a position-regulating circuit and to the input b of which there is applied an actual value signal for the height Ht of the equalized stream *7a;* this signal is advantageously again transmitted by the height monitoring device 48 for the distance between the equalizer 8 (that is, the cutting plane E) and the conveyor belt 3. A signal denoting a possible difference between the two signals which are applied to the signal comparing member then controls, via amplifier 11 and positioning motor 9, the distance between the equalizer 8 and the conveyor belt 3 to maintain a value Ht which is selected by the desired value signal.

In the above-described manner, the location of the cutting plane E of the equalizer 8 is anticipatorilly controlled in dependence on the height Hs of the non-equalized tobacco stream which height is determined in an optoelectronic manner, and additionally on the resistance Rg of the fibers in the non-equalized stream 7 to the flow of a gaseous fluid transversely direction of advancement of the stream, in such a way that the rigidity of the cigarettes 15 is at least approximately constant, even though the height Hs of the non-equalized tobacco stream 7, as well as the quantity tobacco therein, can vary. As already explained previously, the circuitry can so be modified, in correspondence with other parameters in the function generators 53 and 54, that one can achieve an anticipatory control to guarantee a constant quantity of tobacco in the cigarettes 15.

Figure 9:
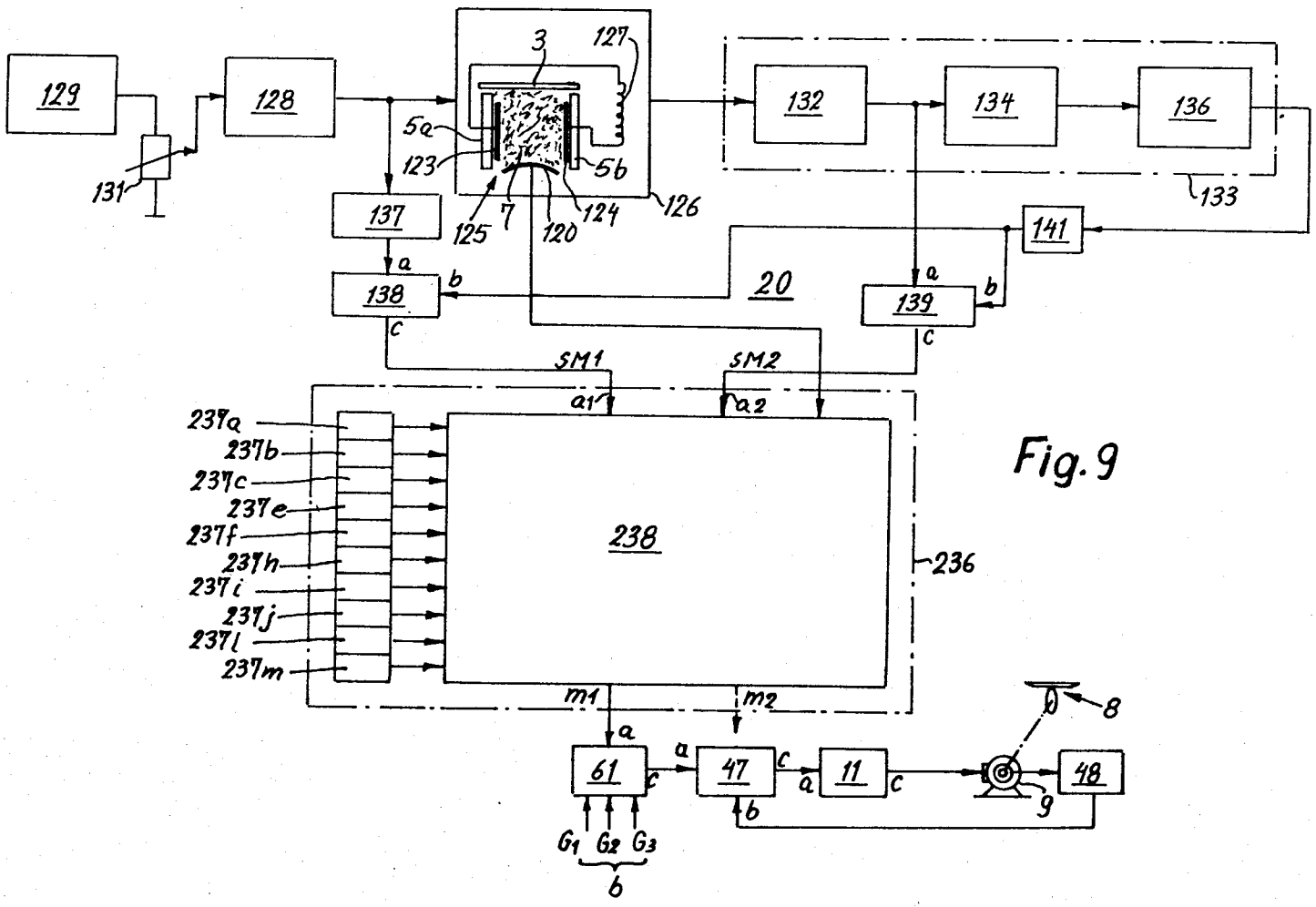
FIG. 9 shows a capacitive device for monitoring the density of the stream.

A further possibility of measuring the density of the non-equalized tobacco stream is shown in FIG. 9. In this embodiment, the density is determined not by the height and the flow resistance of the non-equalized tobacco stream 7 which is advanced by the conveyor belt 3 between stationary walls 5*a* and 5*b* but rather in a capacitive manner. The monitoring station is again located upstream of the equalizer 8 (FIG. 1). The capacitive monitoring device thus replaces the monitoring devices 17 and 18.

FIG. 9 shows the principle of a capacitive monitoring device 20 for the determination of the density M1 of the tobacco stream 7 and of the moisture content M2 of tobacco. The electrodes 123 and 124 of a measuring capacitor 125 are located at the opposite sides of the tobacco stream 7 so that they, when supplied with voltage, establish between themselves a homogeneous electrical field. The measuring capacitor 125 constitutes the capacitance of an electrical high-frequency oscillating circuit 126 which additionally includes a coil 127. The ohmic resistance of the oscillating circuit 126 is not shown.

The oscillating circuit 126 embodies a carrier frequency oscillator 128 which is controllable as to its frequency and oscillates at a basic frequency of 10 MHz. This frequency is so controllable by a control oscillator 129 of 1 KHz that the frequency of the carrier frequency oscillator 128 is periodically varied (wobbled) between two extreme values about the basic frequency. The magnitude of the frequency variations between the extreme values is so selected that it invariably suffices to let the measuring oscillating circuit 126 come in resonance once during each passage of the frequencies of the oscillator 128 between the extreme values. The control of the oscillator 128 takes place by means of the amplitude of constant frequency of 1 KHz of the control oscillator 129 which is adjustable by means of a potentiometer 131.

Thus, the difference between the extreme values of the frequencies of the oscillator 128 can be adjusted via the amplitude. The basic frequency of 10 MHz of the oscillator 128 and thus of the oscillating circuit 126 is sufficiently high to achieve large signal magnitudes.

An amplitude measuring arrangement 133, which consists of a demodulation stage 132, a differentiating stage 134 and a comparing stage 136 is connected to the oscillating circuit 126. The demodulation stage 132 forms an envelope curve of the high-frequency voltage of the circuit 126 and transmits a corresponding signal to the differentiating stage 134 which transmits a zero signal at the occurrence of an extreme value (e.g., maximum) of the demodulated voltage. The comparing stage 136 establishes when the differentiated voltage (a time derivative) of the voltage increase has a zero value, which means that the demodulated voltage of the oscillating circuit 126, which is furnished by the demodulation stage 132, has a maximum value at such instant of time. At this instant of time, the comparing stage 136 transmits an output signal which is applied to a monostable multivibrator 141.

A discriminating stage 137 which forms, together with the differentiating stage 134 and the comparing stage 136, a resonance frequency measuring arrangement, obtains the high-frequency voltage from the oscillator 128 which also applies such voltage to the oscillating circuit 126. The stage 137 transmits an output signal which is proportionate to the frequency of the input signal and is applied to the input a of a storage member 138. The signal which appears at the output of the demodulation stage 132 is applied to the input a of a further storage member 139. The transfer of signals present at the inputs a of the storage members 138 and 139 into the storage members 138 and 139 is controlled by a control signal which is applied to the inputs b of the storage members 138 and 139. This signal is transmitted by a monostable multivibrator 141 which is connected to the comparing stage 136 and transmits, after activation via output signal from the comparing stage 136, a signal of an exactly defined pitch and length, so that it acts as a pulse forming stage. The comparing stage 136 transmits a control signal at the instant at which the measuring oscillating circuit 126 is at resonance, which is determined by means of the differentiating stage 134 from the maximum conditions. Therefore, the signals which appear at the inputs of the storage members 138 and 139 at the time of transfer correspond to the frequency and the damping of the oscillating circuit 126 when the latter is in resonance.

The amplitude of the current of the control oscillator 129 which oscillates at 1 KHz is controllable by means of a potentiometer 131. The effective capacitance of a capacitance diode (not illustrated) in the oscillator 128 and thus the difference (in the example 1 MHz) between the extreme values which the frequency of the voltage of the oscillatory 128 can assume with reference to the basic value of 10 MHz, can be controlled by way of different amplitudes. At the basic frequency of 10 MHz in the oscillator 128, which has been given as an example, the periodical frequency variations of the oscillator 128 can amount to, e.g., ±1 MHz, so that the frequency of the high-frequency voltage which is applied to the oscillating circuit 126 is periodically varied (wobbled) (with the frequency of 1 KHz) between the extreme values of 9 and 11 MHz. The oscillating circuit 126 is provided with a coupling coil (not illustrated), which simultaneously constitutes the oscillating circuit inductance, and the measuring capacitor 125 with the tobacco stream 7 advancing between the electrodes 123 and 124, which forms the capacitance of the oscillating circuit.

The comparing stage 136 includes a resistance (not illustrated) and an operational amplifier (not illustrated) with a very steep characteristic curve, which amplifier, consequently, has practically a switching behavior and achieves its end value even at very small input signals. A signal change is converted, by the monostable multivibrator 141 which is connnected to the amplifier, into a signal of an exact duration and pitch.

The discriminating stage 137 has a special switching element which incorporates a circuit with a resistance, a capacitor and a throttling coil, e.g., of the type known as TAA 661 and manufactured by the firm SGS Deutschland GmbH, Wasserburg(Inn). The output of this switching element, which is available as a structural unit, transmits an electric signal which is closely proportional to the frequency of the input signal.

The storage members 138 and 139 are constructed in the same manner. Each of them consists of a rapidly controllable electronic switch, a storage capacitor and an operational amplifier with a very high ohmic input. The switch opens in response to transmission of a signal from the monostable multivibrator 141 to its input during a precisely defined time period, so that a signal which is present at a different input can be registered by the storage capacitor as a voltage value.

Signals SM1, SM2, which will be discussed presently, appear at the outputs c of the storage members 138 and 139.

The intensity of signal SM1, which denotes to the frequency of the oscillating circuit 126 at the moment of resonance (resonance frequency), is determined by the capacitance of the measuring capacitor 125. This capacitance is influenced by the dielectric constant $\epsilon$ of the tobacco fibers in the tobacco stream 7 and the moisture content of the tobacco stream 7. Thus, the resonance frequency of the oscillating circuit 126 varies in dependence on the dielectric constant.

The signal SM2 which denotes the amplitude of the voltage (1 KHz) of the oscillating circuit 126 at the moment of resonance is a measure of the damping of the oscillating circuit 126, which is determined via the ohmic losses in the dielectric of the measuring capacitor 125. The ohmic losses (tan $\delta$) are also influenced by the density of tobacco in the tobacco stream 7 and by the moisture content of tobacco.

The two values, namely, the dielectric constant $\epsilon$ and the ohmic losses (indicated, among others, also as tan $\delta$), are indicators of different physical properties of the filler *7a* which properties are differently influenced by the two substances of the combination located in the electric field of the measuring capacitor 125.

This different influencing is to be understood in such a manner that the quantities of the two substances differently influence the ratio of the characteristic values $\epsilon$ and tan $\delta$ of the high-frequency oscillating circuit 126.

Inasmuch as, consequently, the dielectric constant $\epsilon$ as well as the loss angle tan 67 of the dielectric of the measuring capacitor 125 are influenced, to different extents, by the density of tobacco and the moisture content of tobacco, the signals SM1 or SM2 which are correspondingly dependent on the capacitance or on the tan $\delta$ (damping) of the oscillating circuit, can be utilized in an evaluating circuit 236 for automatic determination of the mass M1 of tobacco (and the moisture content M2 of tobacco).

The density determination in the evaluating circuit 236 is based on the following considerations:

A functional relationship exists between the two values M1, M2 of the different substances "tobacco" and "moisture" and the monitored values (signals) SM1 and SM2, which can be expressed in the form of polynomial equations:

$$M_1 = a + b.SM_1 + c.SM_1^2 + d.SM_1^3 + \ldots + n_{11}.SM_1^n + e.SM_2 + f.SM_2^2 + g.SM_2^3 + \ldots + n_{12}.SM_2^n$$

$$M_2 = h + i.SM_1 + j.SM_1^2 + k.SM_1^3 + \ldots + n_{21}.SM_1^n + l.SM_2 + m.SM_2^2 + o.SM_2^3 + \ldots + n_{22}.SM_2^n.$$

To solve of these equations, it is first necessary to experimentally establish the relationship between M1, M2, and SM1, SM2. This can be accomplished by maintaining, the moisture content M2 of tobacco at a constant value.

Then the values of the associated signals SM1 and SM2 are respectively measured at different M1 values (that is, tobacco density values). In this manner, there is obtained a first family of curves. In a similar manner, the density of the tobacco, that is M1, is subsequently maintained at a constant value, and M2, that is the moisture content, is varied, while again the values of the associated signals SM1 and SM2 are measured. In this manner, there is obtained a second family of curves.

Now, there can be formed a matrix from the above-mentioned polynomials with powers of SM1 and SM2 which correspond to the number of the value pairs of SM1 and SM2. From this system of equations, there can be determined—possibly by means of a conventional desk calculator—the constants a . . . $n_{22}$ which are associated with the respective powers of the polynomials. The desk model 30 of the calculator series 9800 produced by the firm Hewlett-Packard can be utilized as a calculator of this type. When the calculation is performed for a different number of value pairs and thus of powers, one can readily ascertain which powers are needed for the achievement of a predetermined desired measuring accuracy. As an example, it can be assumed that already the third power brings about negligible values, so that it is only necessary to sense the coefficients a to c, e, f, h to j, l and m as constant determination values for the density M1 (and the moisture content M2) of a tobacco stream to be measured.

The above-mentioned coefficients are stored in coefficient storages *237a* . . . *237m* of the evaluating circuit 236 and they are transmittable, within the calculating cycles, to a calculator 238, to the inputs a1 and a2 of which the signals SM1 and SM2 are transmittable. The calculator cyclically calculates, in accordance with a certain control program, based on the signals which are transmitted to it and which correspond to the stored coefficients a . . . m, as well as based on the signals SM1 and SM2, the density M1 (and the moisture content M2) of the tobacco stream 7 which passes through the measuring capacitor 125. Calculating programs for automatic calculation of polynomials based on constant coefficients and known base numbers for powers are widely known and can be realized, in terms of circuitry, e.g., by the above-mentioned desk calculator of the firm Hewlett-Packard. Then, signals can be derived from the outputs m1 and m2 of the calculator 238, and such signals denote the density M1 of the tobacco (or the moisture content M2 of tobacco).

The principle on which the above-described circuitry is based, is not limited to a reduction of the relations between density and measuring signals to polynomials of the n-th order. It is also possible, commencing from the families of curves for a density which is held constant and a varied amount, to select functions with similar characteristics and to transform them by iterative operations into a satisfactory mathematical expression, to store the corresponding constant determination values and to use such values for automatic determination of the densities or moisture content based on the signals SM1 and SM2.

A further possibility of arriving at constant determination values resides in constantly feeding signals denoting families of curves to a calculator by special feeding devices, for instance, based on scanning. The calculator then automatically arrives at a determination of the optimally approximated function and the constant determination values of the same.

When tobacco sorts and/or moisture contents are very different, it can be recommended to separately determine the functions (polynomials) and the constant coefficients for individual tobacco sorts. This is simplified by the fact that individual tobacco mixtures may very strongly differ from one another but that they are very homogeneous and constant within themselves.

The signal SM1 which denotes the density of the non-equalized tobacco stream 7 is transmitted to the input a of a function generator 61 to the input b of which there are transmitted signals denoting the values of the desired rigidity G1 (soft), G2 (intermediate) and G3 (rigid). In the manner which has been explained with reference to FIG. 7, the signal at the function generator 61 is transmitted as a desired value signal Ht to the input a of the signal comparing member 47 which is incorporated into position-regulating circuit and the input b of which receives a which is transmitted by the monitoring device 48. The output signal denotes the height Ht of the equalized tobacco stream *7a* and corresponds to the actual value. The actual value signal Ht is again transmitted by the device 48 for monitoring the distance between the cutting location E and the conveyor belt 3.

The signal which appears at the output c when a possible difference which corresponds to the regulating deviation exists between the two signals that are supplied to the signal comparing member 47 is transmitted to the control arrangement 11 for the positioning motor 9 for adjustment of the position of the removal location E of the equalizer 8 until coincidence of the desired and actual values is obtained.

The formation of a cigarette rod *7b* and thus the production of cigarettes of constant rigidity (or constant quantity of tobacco) is possible even in this manner.

The above-described so-called "advance controls" (also referred to as "anticipatory controls") of the removal location (removal plane) E of the equalizer 8 in dependence on signals which have been formed before the tobacco stream 7 had reached the removal location E, have the advantage that the tobacco filler *7a* can still be influenced. A drawback is that a supervision of the intervention is missing, which would be achievable only by means of a true regulation which, however, has the disadvantage of a system-caused delay.

A regulation of the stream formation to achieve constant rigidity of the cigarettes is illustrated in FIG. 10.

The signal which is transmitted by the monitoring 22 and denotes to the density or quantity Dg of tobacco in the equalized and densified cigarette rod *7b*, is transmitted to the input a of a function generator 66 in which there are stored value pairs for different distances between the cutting plane E of the equalizer 8 and the conveyor belt 3, and thus for the height Ht of the equalized non-densified tobacco filler *7a*, in dependence on the density of the equalized densified tobacco filler (cigarette rod *7b*). In addition thereto, signals denoting different rigidities G1, G2, G3 of the cigarettes, to which the cigarette production is to be controlled, can be transmitted to the input b of the function generator 66.

The part III of the diagram of FIG. 8 shows the relationship which is established by the function generator 66 between the input signals Dg that are transmitted by the monitoring device 22, the rigidity-dependent signals G1 (soft), G2 (intermediate), G3 (rigid), and the height Ht of the equalized non-densified tobacco filler *7a*.

The signal which appears at the output c of and is formed by the function generator 66 in an analog manner or calculated according to a program in correspondence with a predetermined function in a digital manner, and which corresponds to Ht, is used within the regulating circuit for the control of the equalizing operation in the sense of maintaining the rigidity or the filling force of the equalized densified tobacco rod *7b* and thus of the cigarettes 15 at a constant value.

The signal at the output of the function generator 66 is transmitted, after a comparison with a desired value signal which is transmitted by a desired value generator 66 in a comparing stage 66*b*, as a desired value signal to a regulating circuit for the height Ht of the equalized non-densified filler *7a*. Advantageously, a position-regulating circuit for the distance between the removal location (cutting plane) E of the equalizer 8 and the conveyor belt 3 is suited for this purpose, inasmuch as such circuit simultaneously determines the height Ht of the equalized non-densified tobacco filler *7a*. The signal at the output of the function generator 66 is transmitted as a desired value signal to the input a of a signal comparing member 67 of the position-regulating circuit. An input b of the signal comparing member 67 receives signal which denotes to the height Ht of the equalized non-densified filler *7a*. This signal can be furnished by the diagrammatically illustrated optoelectronic measuring arrangement 17' which is constructed in the same manner as the one which is illustrated in FIG. 2. However, it is more advantageous to form the signal in dependence on the position of the cutting plane E (removal location) of the equalizer 8, inasmuch as such position simultaneously constitutes a measure for the height Ht of the equalized non-densified tobacco filler *7a*. To this end, there serves a height-measuring or monitoring device 48 the output signal of which is transmitted to the output b of the signal comparing member 67. As already mentioned, the measuring arrangement 48 can be an inductively operating, displacement-measuring value generator in which a piece of iron influences the inductivity of a coil in dependence on the position of the iron.

A signal denoting a possible difference between the two signals which are transmitted to the signal comparing member 67 is transmitted as a position regulating deviation to the control arrangement 11 which controls the positioning motor 9 of the equalizer 8 in such a way that the cutting plane E eventually coincides with the desired position indicated by the control signal which is transmitted by the function generator and corresponds to Ht (desired value signal of the position-regulating circuit).

It is possible, by this true regulation, to compensate for long-lasting inaccuracies of the "advance controls", which latter are controlled by signals from the monitoring device 17, 18 or 20, and to assure, over a long time span, the production of cigarettes of constant rigidity.

A switching arrangement 68 renders it possible to transmit the signal corresponding to the density of the cigarette rod *7b* directly, i.e., via conductor 69 which is shown by broken lines, from the monitoring device 22 to the signal comparing member 67 when the advance controls (anticipatory controls) which are effected by the monitoring devices 17, 18 and 20 are to be carried out in a sense to regulate the quantity of tobacco. Such controls to ensure a constant quantity of tobacco (instead of rigidity) in the cigarettes are possible in accordance with the previous description. As a result of the possibility of switching, the controls or regulations can thus be selectively operated for constant rigidities of the cigarettes or for constant quantities of tobacco in the cigarettes in accordance with the desire of the cigarette manufacturer.

It is within the purview of the invention to correct the functions in the individual function generators so as to take into consideration varying tobacco temperatures. This can be accomplished in a relatively simple manner by resorting to program-controlled function generators and can be advantageous inasmuch as pronounced temperature variations can lead to generation of inaccurate or misleading signals by the monitoring devices 17, 18 and 22.

In addition, it is possible to provide a limiting value generator 71 which transmits to the control arrangement 11 upper (line 72) and lower (line 73) threshhold value signals for the amount which must be exceeded or fallen below even when the rigidity is regulated. When one of these limits is reached, the formation of the stream is continued with the corresponding limiting value.

Furthermore, it is within the purview of the invention to control or regulate the manufacture of other rod-shaped objects, which are manufactured in the tobacco processing industry and consist of a material which is suitable for smoking, e.g., cigars or cigarillos.

Finally, it is also contemplated to control or regulate the manufacture of other rod-shaped objects which are produced in the tobacco processing industry, for example, of filter material, in accordance with the invention, provided that a part of the material is to be removed during the manufacture with the purpose of equalizing the stream.

FIG. 10*a* illustrates a modification of the arrangement which is shown in FIG. 10 and wherein density-dependent signals from the monitoring device 22, on the one hand, and strand height-dependent signals from the monitoring device 48, on the other hand, are supplied to the function generator 66. The function generator 66 then generates and transmits analog or digital signals which denote the rigidity of the unwrapped stream in accordance with a program which corresponds to a determined functional relationship between the two input signals. Those output signals of the function generator 66 which denote the rigidity are applied not only to the signal comparing member 66*b* but also to a deviation calculator 66*a* for the determination of the deviation of rigidity-dependent signal transmitted by the function generator 66. The signal at the output of the deviation calculator 66*c* is transmitted to a function generator 66*d* which influences a desired value signal generator 66*a* in such a way that the intensity of the rigidity-dependent desired value signal transmitted by the function generator 66 increases with increasing deviation, and diminishes with diminishing deviation (target shifting). In this manner, it can be achieved that always approximately the same number of articles (cigarettes) statistically lies outside of a predetermined limit which can, for instance, be designated as "limit of unacceptability".

In order to avoid the possibility that certain weight limits would be exceeded, there can be provided a limiting member 66*e* which prevents changes of the weight beyond certain limits.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adapations should and are intended to be comprehended within the meaning and range of equivalence of the claims.

I claim:

1. A method of making an elongated rod-like filler from fibers, especially tobacco shreds, comprising the steps of continuously forming from the fibers an elongated stream which contains a surplus of fibers and advancing the stream lengthwise; equalizing the advancing stream including removing the surplus of fibers; densifying and wrapping the equalized stream to convert the stream into the filler; conveying a current of a gaseous fluid transversely across the advancing stream prior to said equalizing step; generating a first signal in dependence on the resistance of the stream to the flow of said fluid; generating a second signal denoting the height of the equalized stream prior to said densifying step; correcting said first signal in accordance with a function which is indicative of a desired rigidity of the filler and represents a predetermined relationship between said first and second signals; and controlling said equalizing step in dependence on the corrected first signal to maintain the rigidity of the filler at a constant value.

2. The method as defined in claim 1, wherein said gaseous fluid is air.

3. The method as defined in claim 2, further comprising the step of trimming the stream prior to said equalizing step so that the height of the stream is constant prior to removal of said surplus.

4. The method as defined in claim 1, further comprising the steps of monitoring the height of the steam prior to said equalizing step, generating a third signal denoting the height of the stream prior to said equalizing step and varying said controlling step in dependence on variations of said third signal.

5. The method as defined in claim 1, further comprising the steps of monitoring the height of the stream prior to said equalizing step, generating a third signal denoting the height of the stream prior to , generating a fourth signal denoting the density of the stream prior to said equalizing step in accordance with a function which represents a predetermined relationship between said first and third signals and generating a fifth signal for advance control of said equalizing step including correcting said fourth signal in dependence on a function which is selected for a desired rigidity or mass flow of the filler and represents a predetermined relationship between said second and fourth signals.

6. The method as defined in claim 1, further comprising the steps of comparing said second signal with said corrected first signal and changing the location of removal of the surplus in the course of said equalizing step when said second signal deviates from the corrected first signal.

7. The method as defined in claim 6, wherein said step of generating said second signal includes monitoring the position of said location.

8. The method as defined in claim 6, wherein said step of generating said second signal includes monitoring the height of the stream in a contactless manner.

9. The method as defined in claim 1, further comprising the steps of generating a third signal denoting the mass flow of the equalized stream, generating a fourth signal including correcting said third signal in dependence on a function which is selected for a desired rigidity or mass flow of the filler and represents a predetermined relationship between said first and third signals, and utilizing said fourth signal for additionally controlling said densifying step.

10. The method as defined in claim 9, further comprising the steps of comparing said second signal with said fourth signal and changing the location of removal of said surplus when said fourth signal deviates from said second signal.

11. The method as defined in claim 10, wherein said step of generating said second signal includes sensing the position of said location.

12. The method as defined in claim 10, wherein said step of generating said second signal includes monitoring the height of the stream in a contactless manner.

13. The method as defined in claim 10, further comprising the step of selectively discontinuing said step of changing said location when the mass flow of the filler is to remain constant.

14. Apparatus for making an elongated rod-like filler from fibers, especially tobacco shreds, comprising a conveyor; means for continuously supplying to said conveyor fibers to form an elongated stream which contains a surplus of fibers and advances with said conveyor lengthwise; means for equalizing the advancing stream, including means for removing the surplus of fibers from the stream; means for densifying and wrapping the equalized stream to thereby convert the stream into said filler; means for generating first signals denoting the resistance which the stream offers to the flow of a gaseous fluid thereacross upstream of said equalizing means; means for generating second signals denoting the height of the equalized stream upstream of said densifying means; a function generator connected to both said signal generating means and arranged to transmit third signals in correspondence with a function which represents, for a desired rigidity of the filler, a predetermined relationship between said first and second signals; and means for controlling the distance between the location of said equalizing means and said conveyor in dependence on said third signals to thereby determine the height of the equalized stream upstream of said densifying means.

15. The apparatus as defined in claim 14, wherein said conveyor is permeable to air and said means for generating said first signals includes a suction chamber adjacent to said conveyor and arranged to draw a current of air through the stream and the conveyor, and means for monitoring a pneumatic parameter of the air current which passes transversely of and through the stream and is influenced by the resistance of the stream.

16. The apparatus as defined in claim 14, further comprising an additional equalizer upstream of said resistance monitoring means and operative to remove some of the fibers from and to thereby equalize the height of the stream.

17. The apparatus as defined in claim 14, further comprising means for generating fourth signals denoting the height of the stream upstream of said equalizing means and means for transmitting said fourth signals to said controlling means to influence said distance.

18. The apparatus as defined in claim 17, wherein said transmitting means includes a second function generator connected to said means for generating said first and fourth signals and operative to generate fifth signals in accordance with a function which represents, for the desired rigidity of the filler, a predetermined relationship between said first and fourth signals, and means for applying said fifth signals to said controlling means as control signals for the height of the equalized stream upstream of said densifying means.

19. The apparatus as defined in claim 18, wherein said controlling means includes signal-responsive means for shifting said location of said equalizing means, said second function generator constituting a desired value signal generator for said shifting means.

20. The apparatus as defined in claim 17, further comprising means for generating fifth signals denoting the density of the equalized stream upstream of said densifying means and means for generating sixth signals denoting the density of the stream upstream of said equalizing means, said transmitting means including a first function generator connected to said means for generating said first and fourth signals and operative to transmit a first output signal in accordance with a function which represents, for the desired rigidity of the filler, a predetermined relationship between said first, fourth and fifth signals, a second function generator connected to said first function generator and operative to generate a second output signal in correspondence with a function which represents, for the desired rigidity of the filler, a predetermined relationship between said second, fifth and sixth signals, and means for applying said second output signals to said controlling means as a control signal for the height of the equalized stream upstream of said densifying means.

21. The apparatus as defined in claim 20, wherein said controlling means includes signal-responsive means for shifting said location of said equalizing means and said second function generator constitutes a desired value signal generator for said shifting means.

22. The apparatus as defined in claim 21, wherein said means for generating said second signals constitutes an actual value signal generator for said shifting means.

23. The apparatus as defined in claim 22, wherein said actual signal generator includes a device for contactless monitoring of the height of the stream.

24. The apparatus as defined in claim 22, wherein said actual value signal generator includes a device which senses the position of said location of the equalizer relative to said conveyor.

25. The apparatus as defined in claim 14, further comprising means for generating fourth signals denoting the mass flow of the filler and a function generator connected to said means for generating said fourth signals and operative to transmit an output signal in correspondence with a function which represents, for a desired rigidity of the filler, a predetermined relationship between said second and fourth signals, and means for applying said output signal to said controlling means as a control signal for the height of the equalized stream upstream of said densifying means.

26. The apparatus as defined in claim 25, wherein said controlling means includes signal-responsive means for shifting said location of said equalizing means and said last named function generator constitutes a desired value signal generator for said shifting means.

27. The apparatus as defined in claim 26, wherein said means for generating said second signals constitutes an actual value signal generator for said shifting means.

28. The apparatus as defined in claim 27, wherein said actual value signal generator includes a contactless height monitoring device.

29. The apparatus as defined in claim 27, wherein said means means for generating said second signals includes means for monitoring the position of said location relative to said conveyor.

30. The apparatus as defined in claim 25, wherein said correcting means further includes means for determining the variation of said output signal, an additional function generator connected to said determining means, and a desired value signal generator connected to said additional function generator, said additional function generator being operative to control said desired value signal generator so that the intensity of the desired value signal increases with increasing, and diminshes with diminishing variation of the signal which is transmitted by said additional function generator.

* * * * *